US010711472B2

(12) United States Patent
Bond

(10) Patent No.: US 10,711,472 B2
(45) Date of Patent: Jul. 14, 2020

(54) PASS-THROUGH HEAD ASSEMBLY FOR A GRID SHORING SYSTEM

(71) Applicant: Bond Formwork Systems, LLC, Waller, TX (US)

(72) Inventor: Bradley Deen Allen Bond, Katy, TX (US)

(73) Assignee: Bond Formwork Systems, LLC, Waller, TX (US)

( * ) Notice: Subject to any disclaimer, the term of this patent is extended or adjusted under 35 U.S.C. 154(b) by 319 days.

(21) Appl. No.: 15/853,196

(22) Filed: Dec. 22, 2017

(65) Prior Publication Data

US 2019/0194961 A1 Jun. 27, 2019

(51) Int. Cl.

| | |
|---|---|
| ***E04G 25/06*** | (2006.01) |
| ***E04G 11/48*** | (2006.01) |
| ***E04G 11/38*** | (2006.01) |

(52) U.S. Cl.

CPC ..... *E04G 25/061* (2013.01); *E04G 11/38* (2013.01); *E04G 11/483* (2013.01)

(58) Field of Classification Search

CPC ... E04G 11/483; E04G 11/486; E04G 25/061; E04G 25/063; E04G 25/065; E04G 25/066; E04G 25/068

See application file for complete search history.

(56) References Cited

U.S. PATENT DOCUMENTS 3,409,266 A * 11/1968 Jennings ..... E04G 25/02 249/18
9,004,443 B2 * 4/2015 Zhang ..... E04G 11/38 249/18
10,053,875 B1 * 8/2018 Baron ..... E04G 11/486
2012/0042600 A1 * 2/2012 Bacon ..... E04G 11/483 52/632
2014/0263941 A1 * 9/2014 Zhang ..... E04G 11/38 249/18

(Continued)

FOREIGN PATENT DOCUMENTS

CN 102797353 * 11/2012 ..... E04G 11/486
DE 2927116 * 1/1981 ..... E04G 11/486

(Continued)

OTHER PUBLICATIONS

DIN EN ISO 9001, "Slab forming system ISCHEBECK HV" brochure, USA/HV/LI/11.2009, 12 pages.

*Primary Examiner* — Michael Safavi
(74) *Attorney, Agent, or Firm* — Nolte Intellectual Property Law Group

(57) ABSTRACT

A pass-through head assembly is provided. The pass-through head assembly may include a central shaft, a plurality of support bars, a seat, and a seat support plate. The central shaft may extend between a first end plate and a second end plate. Each end plate may define an aperture that aligns with an interior cavity of the central shaft. The plurality of support bars may extend from the central shaft and the second end plate. The seat and seat support plate may each be circumferentially disposed about the central shaft and define apertures that are sized to allow the seat and the seat support plate to pass over the central shaft and the plurality of support bars. The seat may be configured to support one or more beams. The seat support plate may be disposed between the seat and the second end plate.

15 Claims, 5 Drawing Sheets

(56) References Cited

U.S. PATENT DOCUMENTS

| | | | | |
|---|---|---|---|---|
| 2016/0060882 | A1* | 3/2016 | Bond | E04G 11/38<br>264/34 |
| 2018/0080238 | A1* | 3/2018 | Lenkin | E04G 11/483 |
| 2018/0340342 | A1* | 11/2018 | Lizarazu Zaldua | E04G 11/48 |
| 2019/0010717 | A1* | 1/2019 | Baron | E04G 11/52 |
| 2019/0145115 | A1* | 5/2019 | Bacon | E04G 25/08<br>52/127.2 |

FOREIGN PATENT DOCUMENTS

| | | | | | |
|---|---|---|---|---|---|
| DE | 3316557 | C1 | * | 10/1984 | E04G 11/486 |
| EP | 2749713 | | * | 7/2014 | E04G 25/061 |
| GB | 1029131 | A | * | 5/1966 | E04G 11/486 |
| GB | 1457136 | | * | 12/1976 | E04G 11/486 |
| GB | 2099902 | | * | 12/1982 | E04G 11/486 |
| JP | 08042163 | A | * | 2/1996 | E04G 25/065 |
| KR | 20090076813 | A | * | 7/2009 | E04G 11/486 |
| WO | WO-2009009898 | A1 | * | 1/2009 | E04G 13/06 |
| WO | WO-2017134135 | A1 | * | 8/2017 | E04G 11/486 |
| WO | WO-2019156958 | A1 | * | 8/2019 | E04G 11/54 |

* cited by examiner

PASS-THROUGH HEAD ASSEMBLY FOR A GRID SHORING SYSTEM

BACKGROUND

When constructing buildings, parking garages, and other structures, grid shoring systems are often used to carry a load while structural concrete sets or permanent beams are fixed in position. The grid shoring systems may include platform supports that support multiple main beams on head assemblies that include seats. The main beams are typically installed by lowering each main beam onto the seats of adjacent head assemblies, and the main beams and seats may support a plurality of secondary beams extending between parallel main beams. One or more panels may rest on the main beams and secondary beams to form a platform that carries the load.

Typically, the platform support is raised or lowered to position the platform at the correct height for the structure that is being supported. Platform supports often utilize drop head assemblies that may ease the removal of the platform and the platform support. A drop head assembly typically includes a floating seat that is held in position by a seat support plate, which, in turn, is retained by a pin extending through the drop head assembly. When the seat support plate is rotated, both the seat support plate and the seat pass over the pin, dropping the platform and allowing for easy removal of the platform and platform supports.

Recently, platform supports have been developed include both upper and lower head assemblies, allowing the platform supports to position platforms at different heights and support structures at different levels, while reducing the total number of platform supports. Although drop head assemblies have been used for the upper head assembly, using such an assembly for the lower head assembly would typically prevent the platform support from being raised or lowered. This is because the pin that extends through the drop head assembly would prevent the use of a telescoping-type assembly that is commonly used to adjust the height of the platform support. Therefore, the lower seat is usually fixed in position on the head assembly. Although this arrangement does allow for both upper and lower platforms, the upper platform must be removed before the lower platform, which rests on the fixed heads, can be removed. Further, additional head assemblies must be purchased since the upper and lower head assemblies are not interchangeable.

What is needed, therefore, is a head assembly that can drop a platform independently of other platforms and be used as both an upper head assembly and a lower head assembly, allowing for a reduction in the number platform supports and heads that are used.

SUMMARY

Embodiments of the disclosure may provide a pass-through head assembly. The pass-through head assembly may include a central shaft, a plurality of support bars, a seat, and a seat support plate. The central shaft may extend between a first end plate and a second end plate, and each end plate may define an aperture that aligns with an interior cavity of the central shaft. The plurality of support bars may extend from an exterior surface of the central shaft and a surface of the second end plate, and each support bar may extend along a portion of an axial length of the central shaft. The seat may be circumferentially disposed about the central shaft and configured to support one or more beams, and may define an aperture that is sized to allow the seat to pass over the central shaft and the plurality of support bars. The seat support plate may be circumferentially disposed about the central shaft between the seat and the second end plate, and define an aperture that is sized to allow the seat support plate to pass over the central shaft and the plurality of support bars. The seat support plate may be configured to rest on the plurality of support bars in a first position and pass over the plurality of support bars in a second position.

Embodiments of the disclosure may also provide a platform support. The platform support may include a first pass-through head assembly, an adjustable shaft assembly, and a prop. The first pass-through head assembly may include a first central shaft, a first plurality of support bars, a first seat, and a first seat support plate. The first central shaft may extend between a first top end plate and a first bottom end plate, and each of the first top end plate and the first bottom end plate may define an aperture that aligns with an interior cavity of the first central shaft. The first plurality of support bars may extend from an exterior surface of the first central shaft and a surface of the first bottom end plate, and each support bar of the first plurality of support bars may extend along a portion of an axial length of the first central shaft. The first seat may be circumferentially disposed about the first central shaft and configured to support at least a first beam. The first seat may define an aperture that is sized to allow the first seat to pass over the first central shaft and the first plurality of support bars. The first seat support plate may be circumferentially disposed about the first central shaft between the first seat and the first bottom end plate, and may define an aperture that is sized to allow the first seat support plate to pass over the first central shaft and the first plurality of support bars. The first seat support plate may be configured to rest on the first plurality support bars in a first position and pass over the first plurality of support bars in a second position. The adjustable shaft assembly may be supported by the first top end plate and extend into the interior cavity of the first central shaft. The prop may be coupled to the first bottom end plate opposite the first central shaft.

Embodiments of the disclosure may also provide a grid shoring system. The grid shoring system may include a plurality of platform supports arranged in an array, a first plurality of main beams, a first plurality of secondary beams, and at least one panel. Each of the platform supports may include a first pass-through head assembly, an adjustable shaft assembly, and a prop. The first pass-through head assembly may include a first central shaft, a first plurality of support bars, a first seat, and a first seat support plate. The first central shaft may extend between a first top end plate and a first bottom end plate, and each of the first top end plate and the first bottom end plate may define an aperture that aligns with an interior cavity of the first central shaft. The first plurality of support bars may extend from an exterior surface of the first central shaft and a surface of the first bottom end plate, and each support bar of the first plurality of support bars may extend along a portion of an axial length of the first central shaft. The first seat may be circumferentially disposed about the first central shaft and may define an aperture that is sized to allow the first seat to pass over the first central shaft and the first plurality of support bars. The first seat support plate may be circumferentially disposed about the first central shaft between the first seat and the first bottom end plate, and may define an aperture that is sized to allow the first seat support plate to pass over the first central shaft and the first plurality of support bars. The first seat support plate may be configured to rest on the first plurality support bars in a first position and pass over the first plurality of support bars in a second position. The adjustable shaft assembly may be supported by the first top end plate and extend into the interior cavity of the first central shaft. The prop may be coupled to the first bottom end plate opposite the first central shaft. Each main beam of the first plurality of main beams may be coupled to the first seats of two adjacent platform supports of the plurality of platform supports and parallel to at least one other main beam. Each secondary beam of the first plurality of secondary beams may be coupled to the first seats of two adjacent platform supports of the plurality of platform supports, or two main beams of the first plurality of main beams. The at least one panel may be disposed on top of at least two secondary beams of the first plurality of secondary beams.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
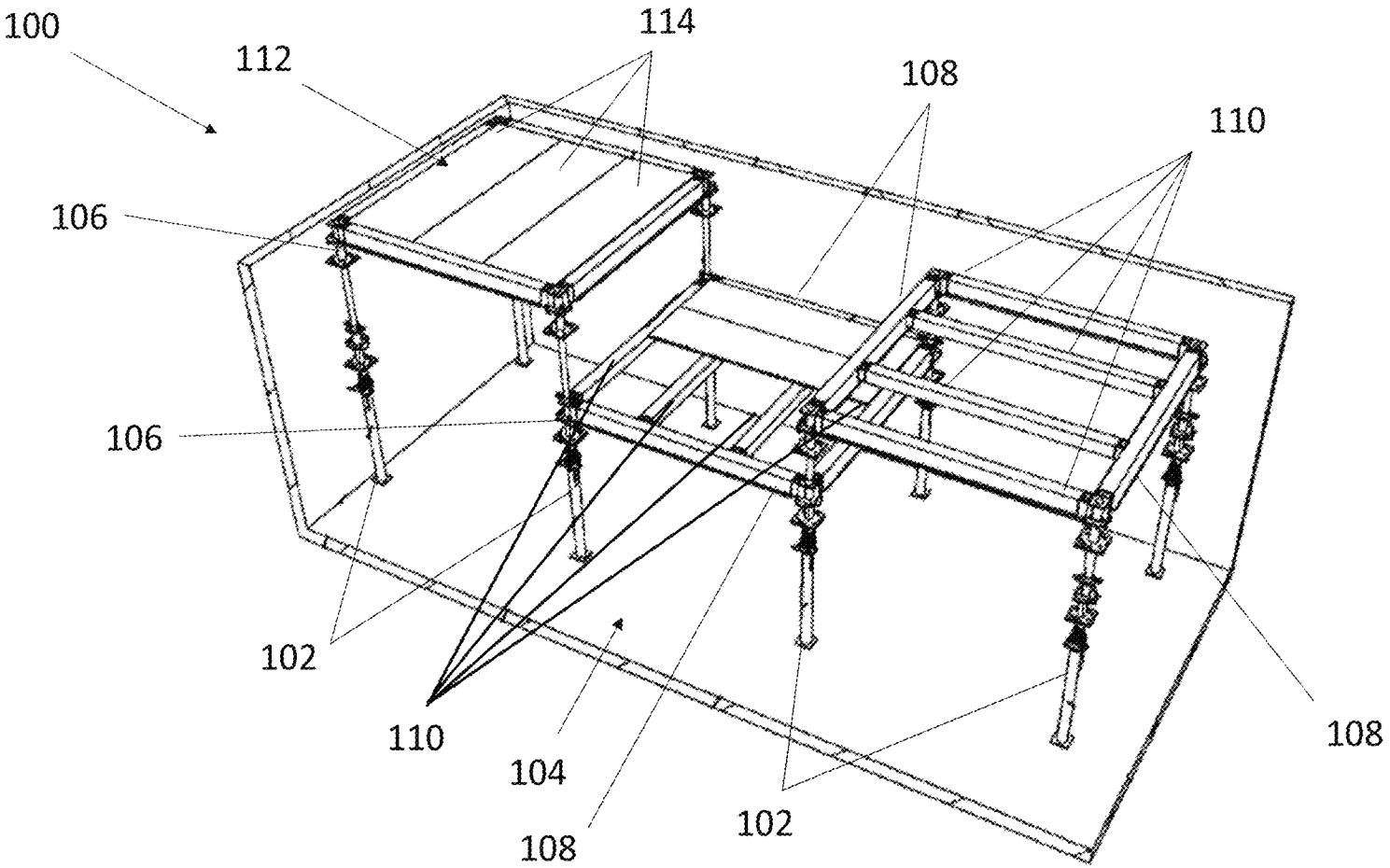
FIG. 1 illustrates an example grid shoring system, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an example grid shoring system 100, according to one or more embodiments disclosed. The grid shoring system 100 may include a plurality of platform supports 102 (four indicated) arranged in arrays. Each array of platform supports 102 may include four platform supports 102, with one platform support 102 at each corner of the array. The platform supports 102 may rest on a floor 104 or other supporting horizontal surface and include one or more head assemblies 106 (two indicated). The head assemblies 106 may be drop head assemblies or fixed head assemblies, as known in the art, or pass-through head assemblies, as described in more detail below with reference to FIG. 2 and FIGS. 3A-3C. A main beam 108 (four indicated) may be coupled to and extend between the head assemblies 106 of adjacent platform supports 102. In one embodiment, each head assembly 106 may be coupled to one main beam 108. In other embodiments, the head assemblies 106 may be coupled to two or more main beams 108. In further embodiments, some head assemblies 106 may be coupled to one main beam 108 and other head assemblies 106 may be coupled to two or more main beams 108.

A plurality of parallel secondary beams 110 (eight indicated) may be coupled to and extend between adjacent head assemblies 106 or parallel main beams 108. As shown in FIG. 1, a platform 112 may be formed by the main beams 108, the secondary beams 110, and multiple panels 114 that are arranged such that the panels 114 are orthogonal to the secondary beams 110, allowing each panel 114 to contact the maximum number of secondary beams 110. Such a configuration may provide even support across the length of the panel 114, reducing the possibility of a deformation occurring in a structure (not shown) that is supported by the grid shoring system 100. In other embodiments, a single panel (not shown) may be used instead of multiple panels 114.

As shown in the exemplary embodiment, the platform supports 102 may include multiple head assemblies 106, allowing adjacent platforms 112 to be positioned at different levels. In other embodiments, adjacent platforms 112 may be at the same level, or there may be a combination of adjacent platforms 112 at the same level and adjacent platforms 112 at different levels. Further, although FIG. 1 illustrates a grid shoring system 100 that includes three adjacent platforms 112, the grid shoring system 100 may be made up of any number of adjacent platforms 112, at the same level or at multiple levels, as necessary to provide support to the structure.

Figure 2:
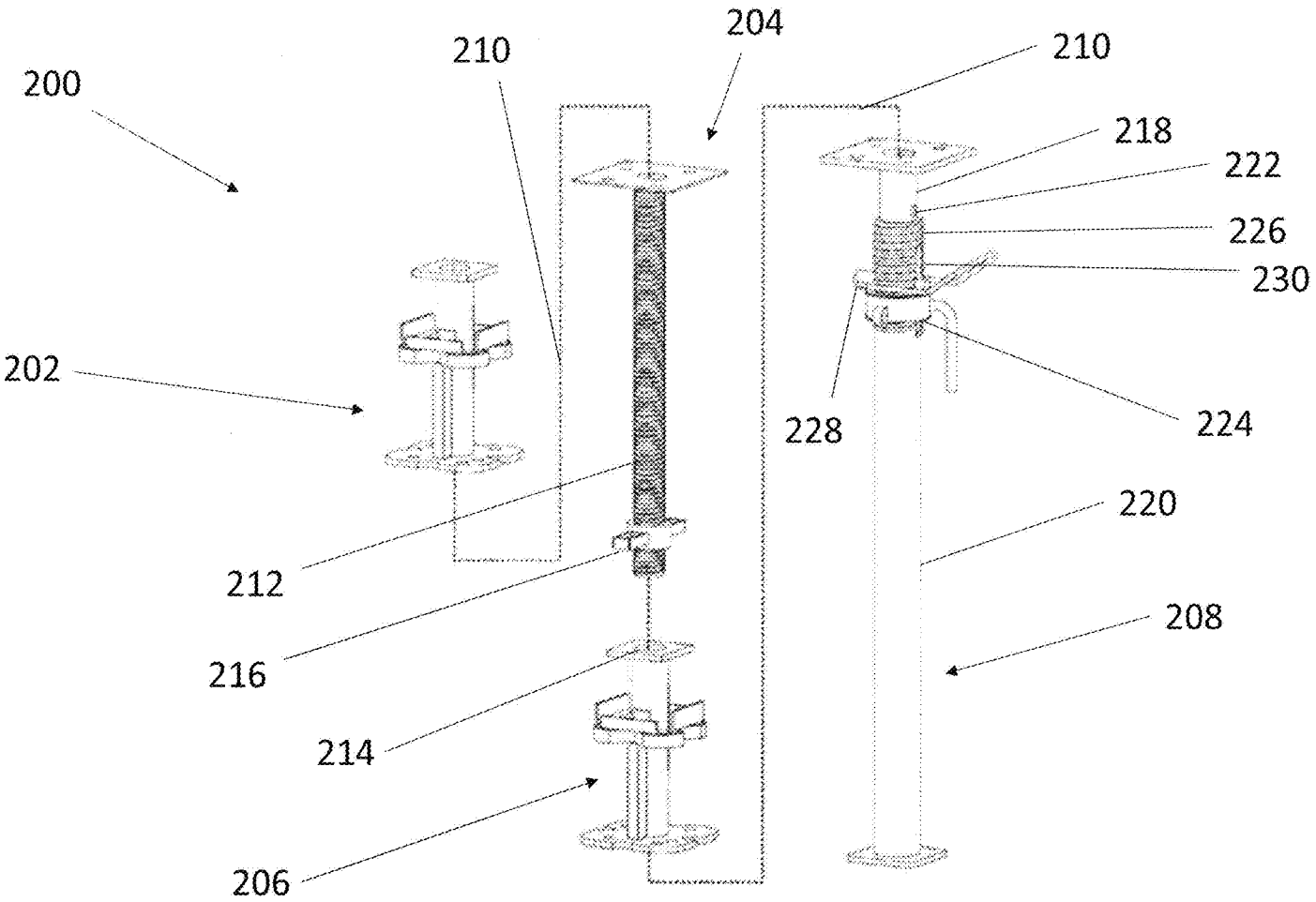
FIG. 2 illustrates an exploded view of an example platform support that may be used in the grid shoring system of FIG. 1, according to one or more embodiments disclosed.

FIG. 2 illustrates an exploded view of an example platform support 200, according to one or more embodiments disclosed. The platform support 200 may be used in place of any of the platform supports 102 illustrated in FIG. 1. The platform support 200 may include an upper head assembly 202, an adjustable shaft assembly 204, a lower head assembly 206, and a prop 208. The upper head assembly 202 and the lower head assembly 206 may be pass-through head assemblies, as shown in the example embodiment and described in more detail below with reference to FIGS. 3A-3C. In other embodiments, the upper head assembly 202 may be a drop head assembly, as known in the art. As shown by a dashed line 210, the upper head assembly 202 may be coupled to the adjustable shaft assembly 204, which may then be coupled to the lower head assembly 206. In another embodiment, the upper head assembly 202 may be omitted and a platform 112 may be supported by the adjustable shaft assembly 204.

The lower head assembly 206 may also be coupled to the prop 208. In one embodiment, the upper head assembly 202 and the lower head assembly 206 may be coupled to the adjustable shaft assembly 204 and the prop 208, respectively, via mechanical fasteners (not shown) such as bolts or pins. This may allow the platform support 200 to be disassembled for easier movement and storage. In other embodiments, the upper head assembly 202 and the adjustable shaft assembly 204 may be welded together, the lower head assembly 206 and the prop 208 may be welded together, or both the upper head assembly 202 and the adjustable shaft assembly 204 and the lower head assembly 206 and the prop 208 may be welded together as a single unit.

The adjustable shaft assembly 204 may include a threaded shaft 212 sized to fit within an aperture 214 of the lower head assembly 206. A collar 216 may be threaded onto the threaded shaft 212 to prevent a portion of the threaded shaft 212 from entering the lower head assembly 206. The collar 216 may be rotated about the threaded shaft 212 to adjust the height of the upper head assembly 202 relative to the lower head assembly 206. In another embodiment, the adjustable shaft assembly 204 may include a shaft with a plurality of holes (not shown) along the axial length of the shaft, and a bolt or pin (not shown) may be inserted into the desired hole to set the height of the upper head assembly 202 relative to the lower head assembly 206.

Similar to the adjustable shaft assembly 204, the prop 208 may be used to adjust the height of the lower head assembly 206. However, the prop 208 may adjust the height of the lower head assembly 206 relative to a floor (not shown) or another horizontal supporting surface. The prop 208 may include an inner prop cylinder 218 and an outer prop cylinder 220. The inner prop cylinder 218 may be sized to fit within an interior cavity of the outer prop cylinder 220. The inner prop cylinder 218 may also include a plurality of apertures 222 that extend through the inner prop cylinder 218, and a retention mechanism 224 may be threaded onto or otherwise coupled to an upper portion 226 the outer prop cylinder 220. The retention mechanism 224 may be rotated about the upper portion 226 of the outer prop cylinder 220 to adjust the position of the retention mechanism 224.

As shown in FIG. 2, the retention mechanism 224 may include a pin 228 that extends through a slot 230 in the outer prop cylinder 220 and one of the plurality of apertures 222 of the inner prop cylinder 218 to prevent a portion of the inner prop cylinder 218 from entering the outer prop cylinder 220 and to set the height of the lower head assembly 206 relative to the floor. In another embodiment, the inner prop cylinder 218 may be threaded and a collar (not shown) may threaded onto the inner prop cylinder 218 and used to set the height of the lower head assembly 206.

Figure 3A:
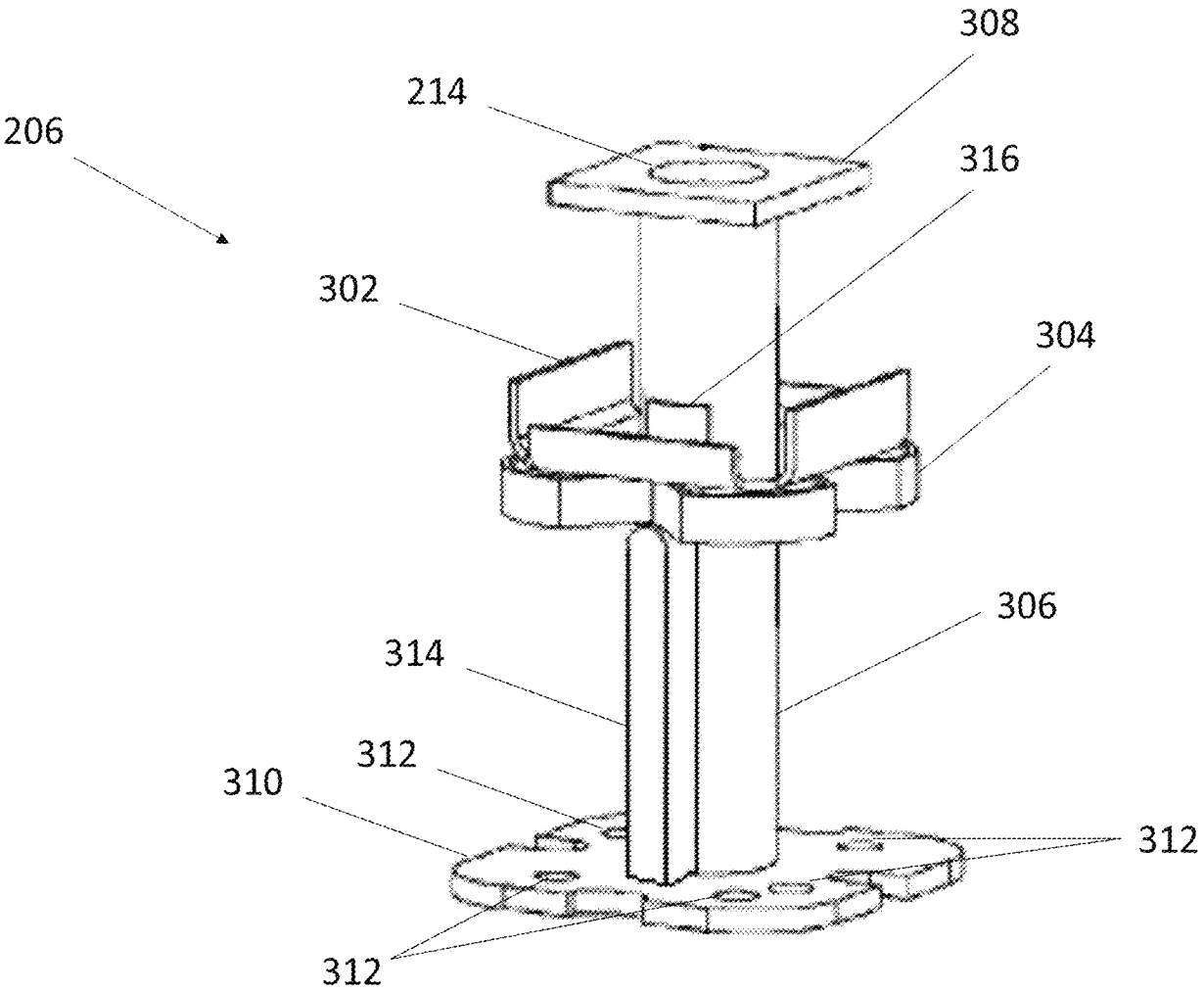
FIG. 3A illustrates an enlarged view of the lower head assembly of FIG. 2.
Figure 3B:
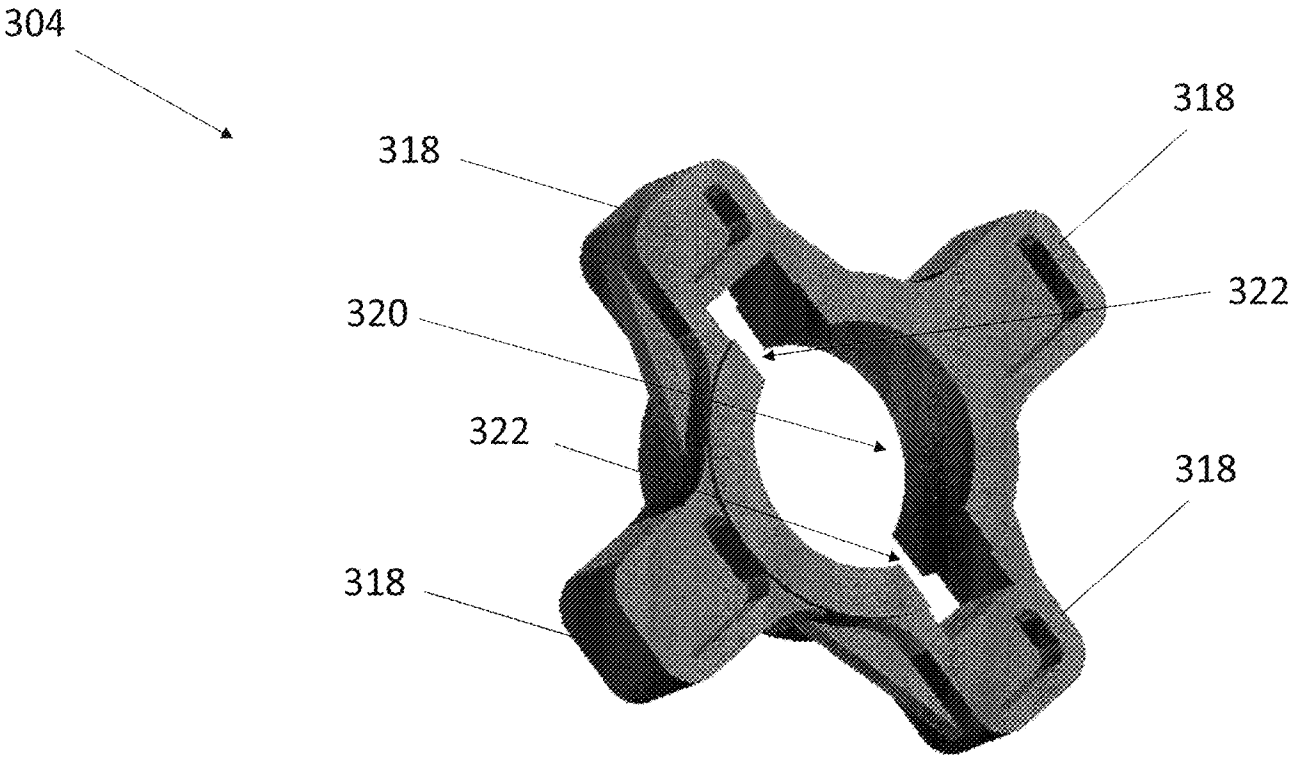
FIG. 3B illustrates an enlarged view of the seat support plate of FIG. 3A.
Figure 3C:
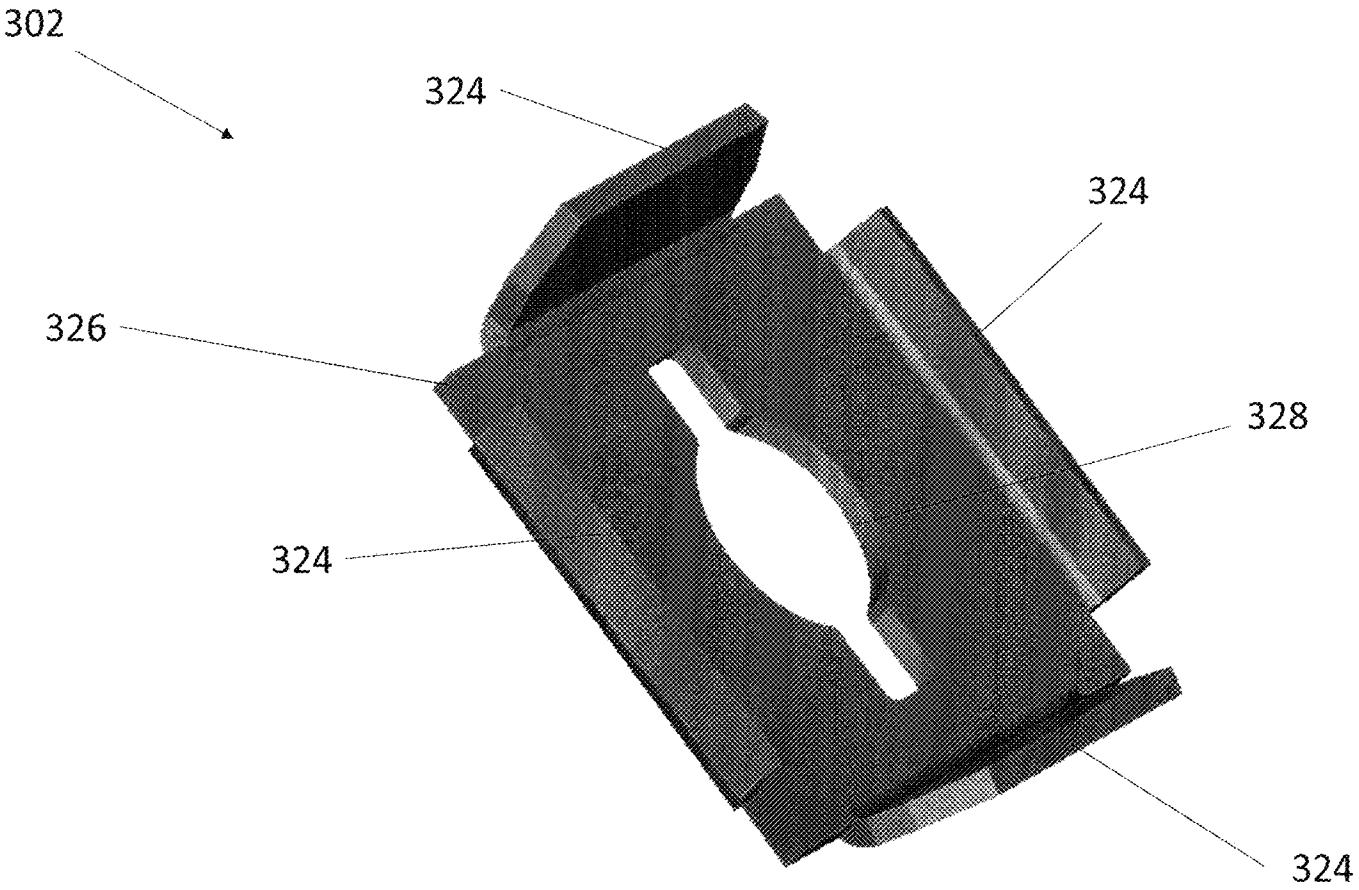
FIG. 3C illustrates an enlarged view of the seat of FIG. 3A.

FIGS. 3A-3C illustrate enlarged views of the lower head assembly 206 of FIG. 2. As shown in FIG. 2, both the lower head assembly 206 and the upper head assembly 202 may be pass-through head assemblies. The pass-through head assemblies may each include a seat 302, a seat support plate 304, and a central shaft 306 that is coupled to an upper end plate 308 and a lower end plate 310. Both the upper end plate 308 and the lower end plate 310 may define an aperture 214 (only one shown) that is aligned with the interior cavity of the central shaft 306. This may allow the adjustable shaft assembly 204 to pass through the lower head assembly 206, as described above. The lower end plate 310 may also include a plurality of apertures 312 that are sized to receive mechanical fasteners (not shown) such as bolts or pins to couple the lower end plate 310 to the prop 208.

As shown in FIG. 3A, the seat 302 and the seat support plate 304 may be disposed about the central shaft 306 and the seat 302 may be supported by the seat support plate 304. The seat support plate 304, in turn, may be supported by two support bars 314 (only one shown) that are welded or otherwise coupled to the central shaft 306 and the lower end plate 310. In another embodiment, the support bars 314 maybe integrally formed with the central shaft 306 and welded or otherwise coupled to the lower end plate 310. The support bars 314 may be equally spaced about the circumference of the central shaft 306. In other embodiments, three, four, or more support bars 314 may be equally spaced about the circumference of the central shaft 306. The lower head 306 may also include one or more tabs 316 that are welded or otherwise coupled to the central shaft 306 above the seat 302. In another embodiment, the tab or tabs 316 maybe integrally formed with the central shaft 306. The tabs 316 may prevent the seat 302 from traveling along the central shaft 306 above a desired point.

FIG. 3B illustrates an enlarged view the seat support plate 304 of FIG. 3A. The seat support plate 304 may include a plurality of support arms 318 equally positioned about the circumference of an annular body 320 that is sized to allow the seat support plate 304 to travel along the central shaft 306. The support arms 318 may be coupled to the annular body 320 through welding or other similar means. In another embodiment, the support arms 318 may be integrally formed with the annular body 320. A portion of the annular body 320 and two of the support arms 318 may be removed to form cutouts 322 that allow the seat support plate 304 to pass over the support bars 314. In another embodiment, the annular body 320 and all four support arms 318 may include cutouts 322. The seat support plate 304 may rest on the support bars 314 in a first position, as shown in FIG. 3A. When the platform support 200 is no longer needed to support a structure (not shown), the seat support plate 304 may be struck with a hammer, mallet, or similar tool to rotate the seat support plate 304 into a second position. The second position may align the cutouts 322 with the support bars 314, causing the seat support plate 304 to drop and contact the lower end plate 310.

FIG. 3C illustrates an enlarged view of the seat 302 of FIG. 3A. The seat 302 may include a plurality of arms 324 that extend vertically or nearly vertically from a central plate 326. In another embodiment, the arms 324 may be welded or otherwise coupled to the central plate 326. The arms 324 may be coupled to main beams 108 and secondary beams 110, as shown in FIG. 1, allowing the platform support 200 to support the main beams 108 and secondary beams 110. The central plate 326 may also include an aperture 328 that is sized to allow the seat 302 to travel along the central shaft 306 and pass over the support bars 314. This may allow the seat 302 and the associated main beams 108, secondary beams 110, and platform or platforms 112 to drop when the seat support plate 304 is lowered.

As shown in FIG. 2, both the upper head assembly 202 and the lower head assembly 206 may be pass-through head assemblies as described above. Such an arrangement may allow the upper head assembly 202 and the lower head assembly 206 to be dropped independently of each other. In another embodiment, the lower head assembly 206 may be a pass-through head assembly and the upper head assembly 202 may be a drop head assembly, as known in the art. This arrangement may also allow the upper head assembly 202 and the lower head assembly 206 to be dropped independently of each other.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A platform support comprising:

a first pass-through head assembly comprising:

a first central shaft extending between a first top end plate and a first bottom end plate, each of the first top end plate and the first bottom end plate defining an aperture that aligns with an interior cavity of the first central shaft, a first plurality of support bars extending from an exterior surface of the first central shaft and a surface of the first bottom end plate, each support bar of the first plurality of support bars extending along a portion of an axial length of the first central shaft, a first seat circumferentially disposed about the first central shaft and configured to support at least a first beam, the first seat defining an aperture sized to allow the first seat to pass over the first central shaft and the first plurality of support bars, and a first seat support plate circumferentially disposed about the first central shaft between the first seat and the first bottom end plate, and defining an aperture sized to allow the first seat support plate to pass over the first central shaft and the first plurality of support bars, the first seat support plate configured to rest on the first plurality support bars in a first position and pass over the first plurality of support bars in a second position;

an adjustable shaft assembly supported by the first top end plate and extending into the interior cavity of the first central shaft; and a prop coupled to the first bottom end plate axially opposite the first central shaft.

2. The platform support of claim 1, wherein the first plurality of support bars are equidistantly spaced about a circumference of the first central shaft.

3. The platform support of claim 1, wherein the first pass-through head assembly further comprises at least one tab extending from the exterior surface of the first central shaft and configured to prevent axial movement of the first seat beyond a location along the axial length of the first central shaft.

4. The platform support of claim 1, further comprising a head assembly coupled to the adjustable shaft assembly.

5. The platform support of claim 4, wherein the head assembly is a second pass-through head assembly comprising:

a second central shaft extending between a second top end plate and a second bottom end plate;

a second seat circumferentially disposed about the second central shaft and configured to support at least a second beam;

a second plurality of support bars extending from an exterior surface of the second central shaft and a surface of the second bottom end plate, each support bar of the second plurality of support bars extending along a portion of an axial length of the second central shaft; and a second seat support plate circumferentially disposed about the second central shaft between the second seat and the second bottom end plate, and defining an aperture sized to allow the second seat support plate to pass over the second central shaft and the second plurality of support bars, the second seat support plate configured to rest on the second plurality of support bars in a first position and pass over the second plurality of support bars in a second position, wherein the second seat defines an aperture sized to allow the second seat to pass over the second central shaft and the second plurality of support bars.

6. The platform support of claim 5, wherein the second pass-through head assembly further comprises at least one tab extending from an exterior surface of the second central shaft and configured to prevent axial movement of the second seat beyond a location along an axial length of the second central shaft.

7. The platform support of claim 5, wherein the second plurality of support bars are equidistantly spaced about a circumference of the second central shaft.

8. The platform support of claim 5, wherein the adjustable shaft assembly is coupled to the second bottom end plate via mechanical fasteners.

9. The platform support of claim 1, wherein the prop is coupled to the first bottom end plate via mechanical fasteners.

10. A grid shoring system comprising:

a plurality of platform supports arranged in an array, each platform support comprising:

a first pass-through head assembly comprising: a first central shaft extending between a first top end plate and a first bottom end plate, each of the first top end plate and the first bottom end plate defining an aperture that aligns with an interior cavity of the first central shaft, a first plurality of support bars extending from an exterior surface of the first central shaft and a surface of the first bottom end plate, each support bar extending along a portion of an axial length of the first central shaft, a first seat circumferentially disposed about the first central shaft, the first seat defining an aperture sized to allow the first seat to pass over the first central shaft and the first plurality of support bars, and a first seat support plate circumferentially disposed about the first central shaft between the first seat and the first bottom end plate, and defining an aperture sized to allow the first seat support plate to pass over the first central shaft and the first plurality of support bars, the first seat support plate configured to rest on the first plurality of support bars in a first position and pass over the first plurality of support bars in a second position, an adjustable shaft assembly supported by the first top end plate and extending into the interior cavity of the first central shaft, and a prop coupled to the first bottom end plate opposite the first central shaft;

a first plurality of main beams, each main beam coupled to the first seat of two adjacent platform supports of the plurality of platform supports and parallel to at least one other main beam;

a first plurality of secondary beams, each secondary beam coupled to the first seats of two adjacent platform supports of the plurality of platform supports, or two main beams of the first plurality of main beams; and at least one panel disposed on top of at least two secondary beams of the first plurality of secondary beams.

11. The grid shoring system of claim 10, wherein at least one platform support of the plurality of platform supports further comprises a head assembly coupled to the adjustable shaft assembly.

12. The grid shoring system of claim 11, wherein the head assembly is a second pass-through head assembly comprising:

a second central shaft extending between a second top end plate and a second bottom end plate;

a second seat circumferentially disposed about the second central shaft and configured to support at least one of a main beam of a second plurality of main beams and a secondary beam of a second plurality of secondary beams;

a second plurality of support bars extending from an exterior surface of the second central shaft and a surface of the second bottom end plate, each support bar of the second plurality of support bars extending along a portion of an axial length of the second central shaft; and a second seat support plate circumferentially disposed about the second central shaft between the second seat and the second bottom end plate, and defining an aperture sized to allow the second seat support plate to pass over the second central shaft and the second plurality of support bars, the second seat support plate configured to rest on the second plurality of support bars in a first position and pass over the second plurality of support bars in a second position, wherein the second seat defines an aperture sized to allow the second seat to pass over the second central shaft and the second plurality of support bars.

13. The grid shoring system of claim 12, wherein the second pass-through head assembly further comprises at least one tab extending from the exterior surface of the second central shaft and configured to prevent axial movement of the second seat beyond a location along the axial length of the second central shaft.

14. The grid shoring system of claim 10, wherein the first support bars are equidistantly spaced about a circumference of the first central shaft.

15. The grid shoring system of claim 10, wherein each first pass-through head assembly further comprises at least one tab extending from the exterior surface of the first central shaft and configured to prevent axial movement of the first seat beyond a location along the axial length of the first central shaft.

* * * * *